US006404997B1

(12) United States Patent
Grace

(10) Patent No.: US 6,404,997 B1
(45) Date of Patent: Jun. 11, 2002

(54) METHOD AND APPARATUS FOR DYNAMICALLY CONTROLLING IMAGE DENSITY

(75) Inventor: Robert Edmund Grace, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/770,244

(22) Filed: Jan. 29, 2001

(51) Int. Cl.[7] ..... G03G 15/00

(52) U.S. Cl. ..... 399/27; 399/38; 399/49; 399/53

(58) Field of Search ..... 399/27, 29, 30, 399/38, 49, 53, 58, 59, 60, 77; 358/406, 504, 296

(56) References Cited

U.S. PATENT DOCUMENTS

| | | | | |
|---|---|---|---|---|
| 4,690,096 A | | 9/1987 | Hacknauer | 399/234 |
| 5,111,247 A | | 5/1992 | Nichols | 399/63 |
| 5,946,534 A | | 8/1999 | Lewis | 399/272 |
| 6,047,142 A | * | 4/2000 | Donaldson | 399/27 |
| 6,134,398 A | | 10/2000 | Grace | 399/58 |
| 6,248,496 B1 | * | 6/2001 | Galloway et al. | 399/30 X |

* cited by examiner

*Primary Examiner*—Sophia S. Chen
(74) *Attorney, Agent, or Firm*—Oliff & Berridge, PLC; Eugene D. Palazzo

(57) ABSTRACT

In an electrophotographic imaging system, a toner density control method and apparatus that uses software modeling to instantaneously compensate for image density variations due to fluctuations in toner concentration. A time-delay model of developer housing dynamics is maintained in machine software of a controller that approximates delay between toner concentration sensing and image development, delay caused by toner-carrier mixing, and/or delay caused by transport of toner-carrier from the development housing to the developer roll. The approximations can be adjusted according to actual measurements over the last several minutes of operation. The controller compares predicted toner concentration sensor signals with averaged actual toner concentration sensor signals to detect long-term and/or short-term drift. Based on the approximations and detected drift, the controller computes and transmits a feed forward correction signal to adjust electrostatic setpoints of an electrostatic controller on a print-by-print basis in order to compensate for fluctuations in toner.

20 Claims, 3 Drawing Sheets

METHOD AND APPARATUS FOR DYNAMICALLY CONTROLLING IMAGE DENSITY

BACKGROUND OF THE INVENTION

The present invention relates to electrophotographic imaging, but more specifically to a method and an apparatus that compensates for variations in toner concentration based on machine characteristics.

In electrophotographic imaging, also known as "xerography," a charge retentive surface, typically known as a photoreceptor, is electrostatically charged and subsequently exposed to a light pattern of an original image to selectively discharge corresponding image areas on the charge retentive surface. The resulting pattern of charged and discharged areas on the photoreceptor forms an electrostatic charge pattern, known as a latent image, conforming to the original image. The latent image is developed by contacting it with a developer material that includes a finely divided electrostatically sensitive powder, i.e., toner particles. Toner is deposited and held on the image areas by an electrostatic charge of the photoreceptor. Thus, a toner image is produced on the photoreceptor in conformity with a projected image of an original document being reproduced. The toner image is then transferred to a substrate, such as a copy sheet of paper, whereupon the image affixed to the substrate is subsequently fused to form a reproduction.

The step in the electrophotographic process in which the toner is applied to the latent image on the photoreceptor is known as "development." During development, varying amounts of toner are placed on the latent image so that the toner particles adhere to charged regions on the surface of the photoreceptor in conformity with the latent image. The amount of toner applied during the development stage determines the image density and color of the corresponding latent image and the reproduction.

Many development techniques are known in the art and. a number of them require uniformly mixed toner particles in a mixture of "carrier" and toner particles. Generally, toner plus carrier equals "developer," also known as a two-component developer. Toner particles are extremely fine and variably responsive to electrostatic fields. Carrier particles comprising ferromagnetic beads, for example, are relatively larger and respond to magnetic fields. In a "magnetic brush" development system of the type disclosed by U.S. Pat. No. 5,946,534 to Lewis and assigned to the same assignee hereof and U.S. Pat. No. 4,690,096 to Hacknauer et al., a development unit, typically one for each separated color, carries a two-component developer mixture in a sump or reservoir that contains augers, transport rolls, and developer rolls. Augers admix the toner and carrier particles, development rolls apply toner to the latent image, and transport rolls or other mechanisms transport mixed particles from the sump to the development rolls.

Contact between toner and carrier during the mixing process triboelectrically charges the toner particles of the mixture causing them to electrostatically adhere to the carrier particles. The developer roll provides a relatively strong rotating magnetic field causing the carrier particles of the mixture to form brush-like strands, much in the manner as iron filings when exposed to a magnetic field. What is thus formed is a brush of magnetic particles with toner particles adhering to the strands of the "magnetic" brush. During the development process, this magnetic brush is swept across the latent image of the photoreceptor so that toner particles separate from the carrier particles and adhere to the photoreceptor in accordance with the magnitude of latent image charge residing on the photoreceptor. The "developed" latent image then moves to the next processing station in the imaging machine while the carrier particles are stripped from the developer roll and re-circulated to the sump for subsequent reuse.

During a reproduction job, the amount of toner consumed at the development roll to develop the latent images depends, in substantial part, on the coverage area in the original document being reproduced. Toner demand will often vary print-to-print subjecting the developer unit to varying degrees of toner consumption. To achieve acceptable toner density in a reproduced image, i.e., image quality, toner must be replenished on an on-going basis so as to maintain sufficient toner concentration in the developer mixture. Development units containing a relatively large mass of developer are not as susceptible to toner concentration fluctuations when image coverage areas fluctuate during a reproduction job stream. Due to mixing/transport delays, as well as delays resulting from toner replenishment after depletion, small mass developer housings are more sensitive to such fluctuations.

The desire to combine multiple development units in a compact imaging system necessitates relatively small developer housings for each of the respective colors. Small housings having a low developer mass suffer from rapid fluctuations in toner concentration (TC) as the image area coverage varies from print-to-print. Toner concentration also fluctuates due to delays in mixing and transport of the developer material. Mixing and transport delays are typically about 10 to 30 seconds due to the time for required for toner replenishment, for admixing to occur, and for transporting the developer to the latent image development rolls. If the coverage area of a print job stream is known sufficiently far in advance, toner can be dispensed and developer can be admixed so that a mixture of the proper toner concentration arrives at the development rolls at the instant the latent image arrives at the development station.

When pixel counting in the original is used to determine coverage area, the required toner concentration information is typically known only a few seconds in advance of development, which is often too late to provide effective toner concentration control. The time required for transport and mixing, on one hand, and the relatively shorter pixel count lead time, on the other hand, cause unwanted fluctuations in toner concentration, which is exacerbated in small mass developer housings. In high quality color reproductions, such variations produce objectionable print quality variations and other deficiencies.

In the course of machine usage, toner concentration levels may also "drift" or vary significantly with aging of the machine. Numerous techniques have been devised to address such long-term variations. One technique includes periodic monitoring of test images using a density sensor at the development station, and then adjusting the field strength and/or other parameters (charge, exposure, developer bias, halftone threshold, or a combination thereof) at the developer unit in order to compensate for deviations. While this may be viable to compensate for long-term drift (e.g., over several hundreds or thousands of reproductions), it is not always adequate to compensate for short-term fluctuations in toner concentration. When image coverage area rapidly fluctuates from print-to-print, a delay of a few seconds between development of a test patch and sensing of density prevents complete compensation of toner concentration fluctuation. The delay also makes it difficult to effect control of electrostatic set points, exposure time, and/or toner concentration to attain high quality reproduction. In addition, the need for print-by-print density information required to make short-term adjustments requires excessively high bandwidth on the data bus between the sensor and the printer's central control unit. Such high data bandwidth negatively impacts other automated functions of the imaging machine that require bandwidth usage, and unnecessarily requires complex test patch generation and detection algorithms. Also, the need for rapid response with this latter approach makes the system susceptible to noise.

The present invention addresses the aforementioned and other problems associated with short-term and long-term fluctuations in toner concentration in an electrophotographic or electrostatographic imaging system.

SUMMARY OF THE INVENTION

In accordance with one embodiment of the invention, there is provided a method of dynamically controlling image density in an electrophotographic imaging system that includes at least one development station for applying toner to an electrostatic latent image comprising generating a software behavioral model of toner concentration, toner mixing delay, and/or transport of toner at various stages during a development cycle of the latent image and dynamically adjusting the amount of toner applied to the latent image according to the software behavior model during a reproduction job stream. The method may also include altering electrostatic set points of an electrostatic controller of the imaging machine to maintain a desired toner density in the latent image; controlling toner concentration in a two-component developer mixture of toner and carrier particles; and/or correcting the software behavior model according to actual measurements of behavior of at least one of toner concentration, mixing delay, and transport delay during a reproduction job stream.

The method is particularly suited but not limited to controlling short-term fluctuations of toner concentration in small mass developers. In addition, the method may be supplemented to correct long-term fluctuations and/or drift using a conventional density sensor to less frequently monitor toner density.

In accordance with another aspect of the present invention, there is provided a toner density control method that uses software modeling of an imaging machine to compensate for long-term and/or short-term variations in toner concentration at a developer roll of the machine. A model of developer dynamics is maintained so that a central controller of the imaging machine may approximate in advance required set points or other parameters of the developer to compensate for toner deficiency based on a projected time delay for a replenished supply of a toner-depleted developer mixture to reach the development roll, which time delay may include a delay introduced during mixing or transport of toner and carrier particles from the dispenser to the developer rolls.

In accordance with another aspect of the invention, an apparatus is provided that dynamically controls image density in an electrostatographic imaging system having at least one development station for applying toner to an electrostatic latent image where the apparatus includes a software model that emulates the behavior of at least one of toner concentration, mixing delay of toner, and transport of toner at various stages during a development cycle of the latent image; and a controller that dynamically adjusts the amount of toner particles applied the latent image according to the software model during a reproduction job stream.

In yet another aspect of the invention, a controller adjusts the approximated time delays of a model in accordance with actual measurements of short-term variations.

These and other features and aspect of the invention will become apparent upon review of the following description, taken in connection with the accompanying drawings. The invention, though, is pointed out with particularity by the appended claims.

DESCRIPTION OF ILLUSTRATIVE EMBODIMENTS

Figure 1:
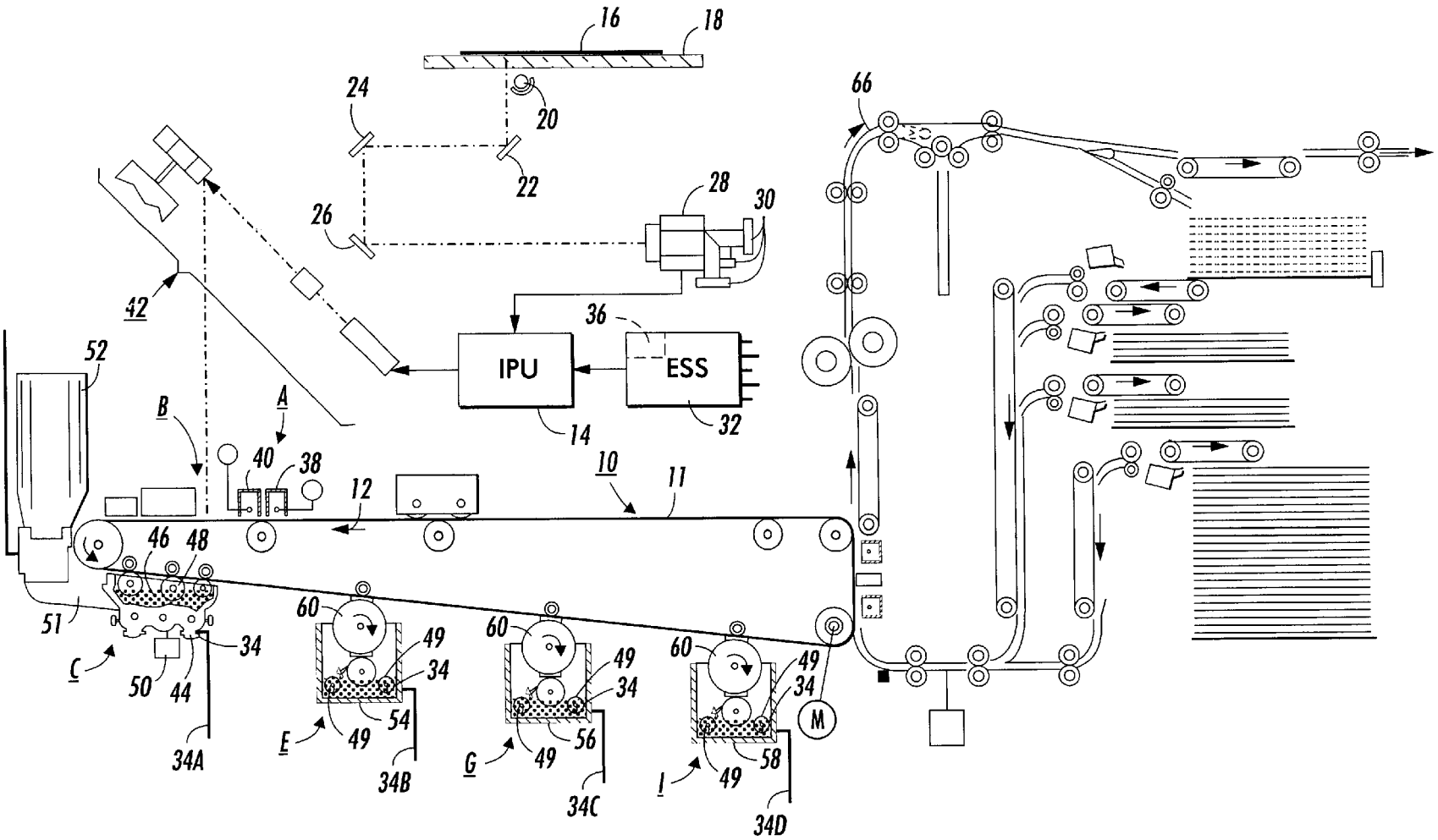
FIG. 1 illustrates a multipass color electrophotographic imaging machine in which aspects of the present invention may be deployed.

FIG. 1 shows an exemplary multipass color electrostatographic reproduction or imaging machine that may utilize various embodiments of the present invention. The imaging machine, which is more particularly described in incorporated U.S. Pat. No. 6,134,398 assigned to the same assignee hereof, includes a photoreceptor belt 10 having a photoconductive surface 11 that carries an electrostatic latent image formed thereon to various image processing stations along the path of belt 10 in the direction 12. Controlled amounts of toner are applied to each latent image as it passes development stations C, E, G, and I in a multipass operation. The amount of toner applied is dictated, among other things, by toner concentration and electrostatic potentials at the development unit. To control the amount of toner applied to the latent image, electrostatic potentials and other electrical set points may be controlled almost instantaneously whereas toner concentration at the development roll is subject to mixing and transport delays.

As known in the art, color reproductions may be derived from a computer generated image that is electronically conveyed to an image processor 14 or from an original document 16 placed on the surface of a transparent platen 18. In the latter case, a scanning assembly including a light source 20 illuminates the document 16 whereupon light reflected from document 16 is reflected by mirrors 22, 24, and 26 through a series of lenses (not shown) and a dichroic prism 28 to three color separating, charged-coupled linear photosensing devices (CCDs) 30 where the information is read. Each CCD 30 outputs a digital image signal that is proportional to the intensity of the incident light of a respective color separated region of original document 16. The digital signals represent each pixel and are indicative of blue, green, and red densities. They are conveyed to the IPU 14 where they are converted into color separations and bit maps, typically representing yellow, cyan, magenta, and black.

As previously indicated, the image coverage area of original document 16 may vary from print-to-print, and this may have a deleterious impact on image density of the reproduced image should toner concentration fluctuate outside of a pre-established range. Color separation and bit map information may be used to control the delivery of toner at development stations C, E, G, and I in order to achieve a desired toner density in the developed latent image, but very often, this is marginally effective to compensate for variations of toner density in the latent image during print-to-print fluctuations in toner concentration. Although illustrated separately, the housing of development stations C, E, G, and I are often combined for compactness in a single unit having respective compartments for the individual toners. As previously indicated, this makes the system more susceptible to toner concentration fluctuations.

The imaging machine of FIG. 1 includes an electronic subsystem (ESS) 32 that comprises a central processor unit (CPU), memory, and a display or user interface (UI). ESS 32 with the help of toner concentration sensors at connections 34*a*, 34*b*, 34*c*, and 34*d*, as well as an optional pixel counter 36, reads, captures, prepares and/or manages toner concentration, electrostatic set points, and other machine functions. In addition, ESS 32 performs multi-tasking operations such as imaging, development, sheet delivery and transfer, and the operating or "on" time control mode and/or algorithm for each of the development units.

Initially, in a first imaging pass, photoreceptor 10 passes charging station A where corona generating devices 38 and 40 charge photoreceptor 10 to a relatively high, substantially uniform potential. Next, in this first imaging pass, the charged portion of photoreceptor 10 advances through an imaging station B. At imaging station B, the uniformly charged belt 10 is exposed to the scanning device 42, which forms a latent image on surface 11 of belt 10 by discharging certain regions thereof, e.g., text or graphic patterns, in accordance with one of the obtained color separations and bit map outputs, e.g., black, of the scanning device 42. Scanning device 42 is a laser Raster Output Scanner (ROS) that creates color separation images as a series of parallel scan lines having a certain resolution, generally referred to as lines per inch.

Figure 3:
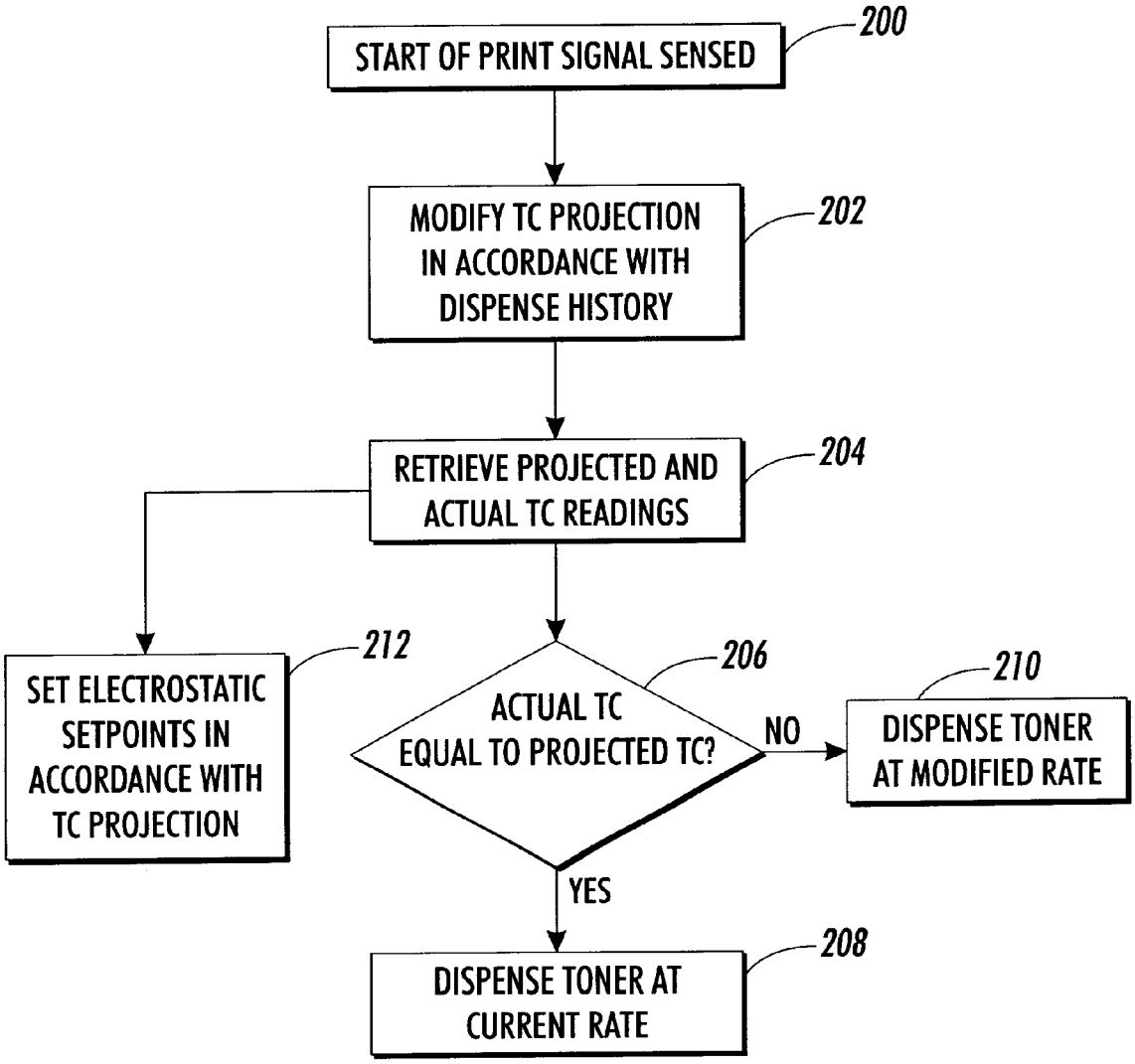
FIG. 3 is an exemplary flowchart setting forth steps according to one aspect of the invention.

At a first development station C, a non-interactive two-component development unit 44, advances developer material 46 containing, for example, charged toner particles and carrier particles in the form of ferromagnetic beads of a desired and controlled ratio into contact with a donor roll 48, and donor roll 48 then advances charged toner particles admixed with developer material 46 into contact with the latent image and any latent target marks on surface 11. The sump or reservoir of developer housing 44 includes mixing augers that mix toner and carrier particles. Transport of developer material 46 from the sump of the developer housing 44 to the latent image on the surface 11 generally takes a few seconds. Development stations E, G, and I, which include donor rolls 60 and dispense remains unchanged in block 208. If so, then the long term drift is computed based on the results of the comparison between projected and actual toner concentration in block 210, and the dispense rate is modified according. In either case, setpoints stored in electrostatic controller 144 are appropriately adjusted and the development process is initiated in block 212. The process described in FIG. 3 is repeated for each print.

Development unit 44 may also include a plurality of magnetic brush and donor roller members, plus rotating augers or other means for mixing toner and carrier particles, all of which contribute to the delay of applying toner of a desired concentration to the latent image. A special feature of non-interactive development is that adding and admixing of toners can continue even when development is disabled. Therefore the timing algorithm for the adding and admixing function can be independent of that for the development function, as long as admixing is enabled whenever development is required. These donor roller members transport charged toner particles to the latent image for development thereof which tones the particular color separation image areas and leaves other areas untoned. Power supply 50 electrically biases development unit 44. Other development stations 54, 56, and 58 have similar biasing. In accordance with an important aspect of the present invention, timing algorithms for admixing and transport may be altered in advance of toner needs based on anticipated delays in transport and mixing.

Development or application of the charged toner particles to the latent image depletes the level and hence the concentration of toner particles in developer material 46. Different jobs of several documents being reproduced will cause toner depletion at different rates depending on the sustained, copy sheet area toner coverage, or toner area coverage level of the images thereof being reproduced. In a machine using a two-component developer material, as here, such depletion undesirably changes the concentration of such particles in the developer material. Momentary depletion is exacerbated when the developer mass is relatively small. In order to maintain the desired concentration of toner particles in the developer material 46 (in an attempt to insure the continued quality of subsequent images), adding and admixing functions of the development unit 44 must be operating or turned "on" for some controlled period of time in order for the hopper 50 to replenish the development unit 44 with fresh toner particles from source 52. Such fresh toner particles must then be admixed with the carrier particles in order to properly charge them triboeletrically.

On a second and subsequent passes of an image region on belt 10 of the multipass imaging machine, corona devices 38 and 40 recharge and adjust the voltage level of both the toned (from the previous imaging pass), and untoned areas on photoreceptor 10 to a substantially uniform level. This prepares the surface 11 to receive additional latent images on which toner particles of other colors are deposited by development stations E, G, and I. Recharging devices 38 and 40 substantially eliminate any voltage difference between toned areas and bare untoned areas, as well as to reduce the level of residual charge remaining on the previously toned areas so that subsequent development of a latent image of a different color separation is formed across a uniform development field. Imaging device 42 is then used on the second and subsequent passes of the multipass imaging machine to superimpose a subsequent latent image of a particular color separation image by selectively discharging the recharged photoreceptor 10.

Figure 2:
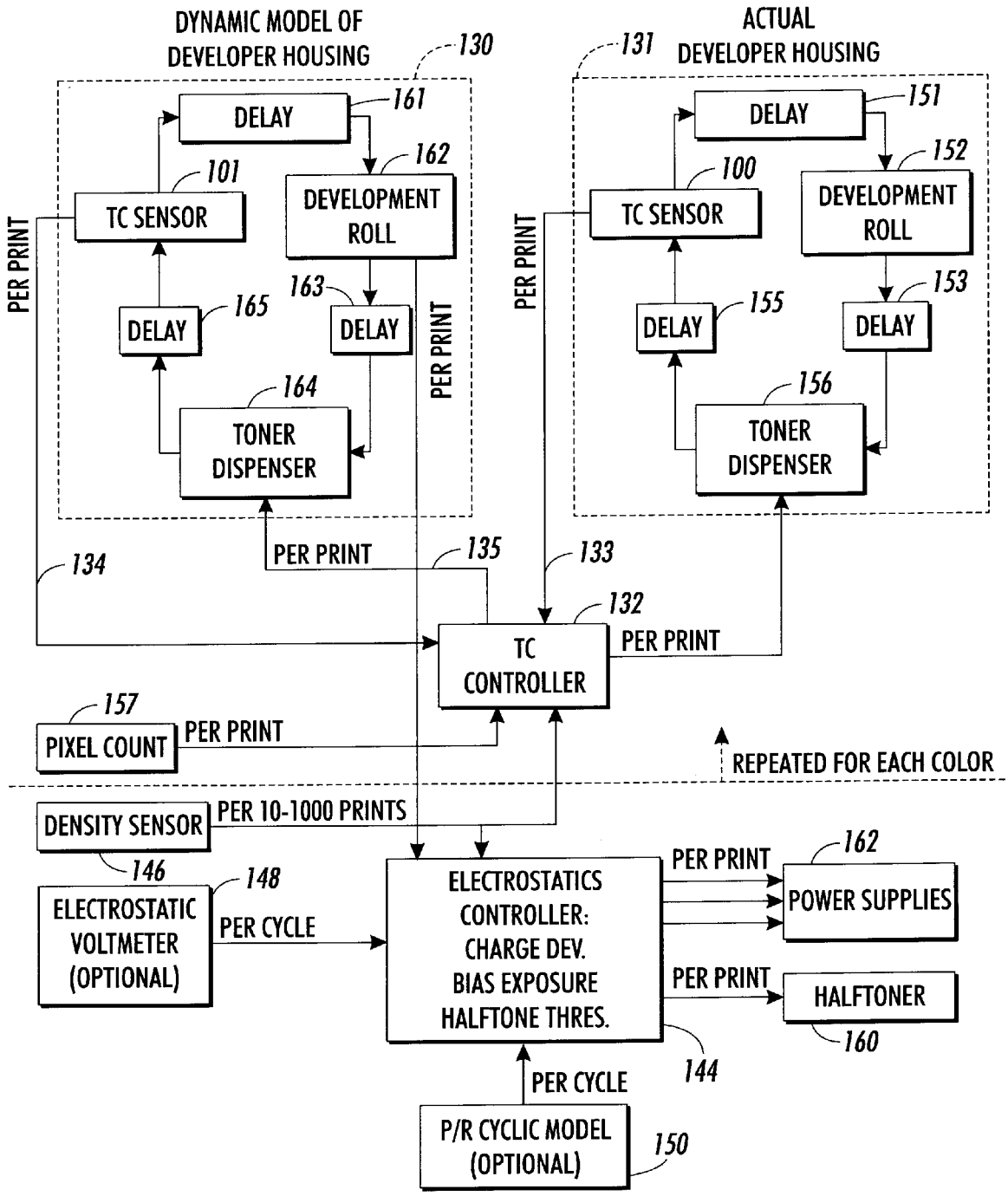
FIG. 2 is a block diagram illustrating a control method and apparatus of one of the development housings of the imaging machine of FIG. 1 according to one embodiment of the present invention.

FIG. 2 depicts a block diagram illustrating toner concentration modeling that may be implemented for each developer housing 44, 54, 56, or 58 of the imaging machine of FIG. 1 in order to carry out an embodiment of the present invention. Module 130 symbolically represents a dynamic software model that uses projected delays in toner mixing, transport, and/or sensing to generate appropriate control signals for electrostatic controller 144 and toner concentration controller 132, separately or in conjunction. Such modeling may be implemented by ESS 32 of the exemplary imaging machine of FIG. 1. Module 131, on the other hand, represents actual response times and propagation delays due to toner mixing and transport within the development housing, as well as delays between density sensing and toner dispensing. These are generally fixed values, but may be adjusted periodically or otherwise to account for machine aging. In addition, time delays and behavioral values of the various elements of module 131 are characteristic of and unique to the type of imaging machine.

Toner concentration controller 132, which may be implemented by ESS 32, responds to signals from software module 130 and 131 to control replenishment of toner from, for example, toner supply 51 of FIG. 1. Controller 132 also responds in a conventional manner to print-by-print pixel count information to replenish toner based on coverage area of original document 16 and to image density sensor 146 that supplies a feedback signal to electrostatic controller 144 every ten to one thousand print cycles. Electrostatic voltmeter 148 cyclically supplies a feedback signal to electrostatic controller 144 to maintain electrostatic set points within predetermined ranges. Optionally, a photoreceptor cyclic module 150 may be provided to model the behavior of photoreceptor 10 in much the same way as module 130 and 131 to compensate for start-up transient conditions. Power supplies 162 and halftone module 160 receive outputs from the electrostatic controller for adjustment on a per print basis.

Referring specifically to an exemplary modeling protocol provided by software module 130, virtual sensor 101 represents projected toner concentration levels at sensor 34 of FIG. 1 based on dispense history module 164 indicative of toner dispense history and a dynamically programmed time delay 165. Time delay 165 emulates the time required to sense replenishment of toner in housing 44, for example, after toner dispensation and admixing thereof with carrier particles. Module 164 may be a sensor response function or a bank of memory data that is accessed in a way to emulate toner concentration behavior at the sensor 34 in response to toner replenishment at the development housing.

Development roll sensor 162 of software module 130 represents projected toner concentration at development roll 48 (FIG. 1) based on the value of virtual sensor 101 and a dynamically programmed time delay 161. Time delay 161 indicates the time delay for changes in toner concentration sensor readings at sensor 101 to appear at the sensor 162. This delay emulates the time for transport of developer material from the sump to the developer rolls. On a print-by-print basis, toner concentration controller 132 informs the software module 130 of toner dispense command signals via connection 135.

Software module 130 also projects a delay 163 between sensing toner concentration and/or density at the developer roll 48 and dispensing of toner within the developer housing 44. Based on the aforementioned programmed delays, software module 130 anticipates a need to replenish toner by sending a control signal to the toner concentration controller 132 over path 134, or a need to adjust image density by supplying a feed forward correction signal to electrostatic controller 144 via line 133. This is done on a per print basis.

The values reflected by modeled software elements 101, 161, 162, 163, 164, and 165 of software module 130 may be dynamically altered or corrected during machine operation to compensate for drift or to fine tune their respective levels to better project an appropriate correction signal to compensate for toner concentration fluctuations. Dynamic altering is accomplished by comparing their values with averaged, corresponding actual values of machine parameters over, for example, a past few minutes of machine operation. Actual values may be obtained from module 131, which is subsequently described. The period of averaging, however, may vary widely from much shorter periods to much longer periods. In addition, actual values reflecting actual machine operation may be processed by methods other than averaging, or may simply be sampled without averaging or other processing.

Importantly, software module 130 generates a feed forward correction signal on an output line 133, e.g., a data bus, that controls set points of electrostatic controller 144 to instantaneously compensate for unwanted short-term and/or long-term fluctuations. By knowing or anticipating toner concentration shortages in advance before the developer reaches the latent image, parameters of the electrostatic controller can advantageously be adjusted to compensate for the shortfall. The feed forward signal instantaneously adjusts parameters of controller 144, such as the magnitude of charge on the photoreceptor, developer bias generated by source 50, for example, exposure time, and/or halftone threshold values in order to compensate for any toner density variation due to anticipated toner concentration fluctuation.

Parameters of development hardware module 131 parallel those of software module 130 and represent actual developer housing dynamics of the imaging machine. Toner concentration sensor 100 indicates the actual concentration of toner in the developer mixture 46 (FIG. 1) at a specific point in the flow path of the development unit, while development roll 152 is equivalent to development roll 48 (FIG. 1), for example. Time delays 151, 153, and 155 are actual measured values based on the type and characteristics of the particular imaging machine. Such delays, among other things, reflect the time period for transport of developer material between and among the developer reservoir, transport rolls, developer rolls at the development stations during development of the latent image, or other behavioral characteristics of the developer housing or the imaging machine that impact toner density.

A density sensor 146 senses actual print density of the developed latent image at a sample interval of, for example, ten to one thousand prints, in order to compensate for long-term drift. The density signal is applied to the toner concentration controller 132 and the electrostatics controller 144. In accordance with one aspect of the invention, the frequency of acquisition of print density data from sensor 146 is substantially reduced since information from module 130 fed to the electrostatics controller via data line 133 provides adequate correction for short-term fluctuations. The acquisition of density data, usually obtained from a test patch on or near the developed latent image, requires a very high bandwidth in a data path between the density sensor and the ESS 32, which processes the density data in order to generate and transmit the appropriate toner concentration adjustment or correction signals. The use of the dynamic software model 130 to estimate toner concentration variations and to generate a correction signal to compensate for the variations, as opposed to obtaining and processing data from density samples on a per print basis, substantially reduces this bandwidth and eliminates the need for complex test patch generation and detection algorithms. Electrostatic voltages of the electrostatic development fields may be measured using an electrostatic voltmeter 148, the resulting measurement being transmitted from the voltmeter 148 to the electrostatic controller 144.

A model of short-term photoreceptor (P/R) cyclic behavior 150 may be incorporated into the electrostatics controller 144 to enable correction for start-of-run transients. It should be noted that any part or all of the modeled parameters can be made adaptive so they can be tuned automatically to optimally match the operating conditions present in each machine.

Pixel counter 157 provides the primary print-by-print information with which toner dispense is regulated by toner concentration controller 132.

Toner concentration controller 132 also receives signals from the actual toner concentration sensor 100 as well as virtual sensor 101 of the dynamic model 130, which corresponds to sensed and projected toner concentrations at the toner concentration sensor, respectively. Deviations between projected and actual sensed toner concentration levels are periodically brought into alignment, for example, every few minutes. When the actual toner concentration at sensor 100 is lower than the projected toner concentration, control signals from the toner concentration controller 132 are sent to the toner dispenser 156 where the toner dispenser 156 comprises a toner container, auger, control circuit, and the motor that drives the auger of developer housings 44, 54, 56, or 58 (FIG. 1), as more particularly described in the aforementioned incorporated U.S. Pat. Nos. 6,134,398 and 5,946,534. The control circuit responds to control signals from controller 132 to regulate the amount and rate at which toner is dispensed from the container.

Referring to FIG. 3 there is shown a flowchart outlining an illustrative method of one embodiment of the present invention. A start of print signal, initiated from a user interface of the imaging machine activates the software for dynamic model 130 of developer housing as seen in block 200. The toner concentration projection is modified in accordance with the dispense history over the last several minutes of operation of the developer unit 38 as seen in block 202. The projected and actual toner concentration are then retrieved in block 204, using the modified projected toner concentration of block 202. The average actual toner concentration, which is provided to toner concentration controller 132 on a per print basis, is then compared to the projected toner concentration in block 206 to determine if there is a need to compensate for long term drift. If not, then dispense remains unchanged in block 208. If so, then the long term drift is computed based on the results of the comparison between projected and actual toner concentration in block 210, and the dispense rate is modified accordingly. In either case, setpoints stored in electrostatic controller 144 are appropriately adjusted and the development process is initiated in block 212. The process described in FIG. 3 is repeated for each print.

Although the above embodiments are described relative to a two-component developer mixture and relative to particular machine characteristics, software modeling may equally be applied to single-component developer material or to other aspects of operation of the imaging machine where image density fluctuates according to predictable machine characteristics. Thus, the invention is not limited to image density control for a two-component development system. Based on the foregoing description, one, skilled in the art can easily ascertain modifications, substitutes, applications, and/or variations. It is the intent to include such modifications, substitutes, applications, and/or variations without departing from the spirit and scope of the invention.

What is claimed is:

1. A method of dynamically controlling, image density in an electrophotographic imaging system that includes at least one development station for applying toner to an electrostatic latent image, the method comprising:

generating a software behavioral model of at least one of toner concentration, toner dispensing, mixing delay of toner, and transport of toner at various stages during operation of the imaging system; and dynamically adjusting the amount of toner applied to the latent image according to the software behavioral model during a reproduction job stream.

2. The method as recited in claim 1, wherein the dynamically adjusting step includes:

altering electrostatic set points of an electrostatic controller of the imaging system in order to maintain a desired toner density in a developed image.

3. The method as recited in claim 2, wherein the dynamically adjusting step further includes:

controlling toner concentration in a two-component developer mixture of toner and carrier particles.

4. The method as recited in claim 2, wherein the generating step includes:

correcting the software behavioral model according to actual measurements of behavior of at least one of toner concentration, dispensing, mixing delay, and transport delay during a reproduction job stream.

5. The method as recited in claim 4, wherein the correcting step is repeated periodically during a reproduction job stream.

6. The method as recited in claim 4, further comprising periodically compensating for long-term drift in a desired toner density using an image density sensor that senses toner density of a developed image.

7. The method as recited in claim 4, further comprising periodically correcting the software behavioral model according to pixel count information of an original document being reproduced.

8. A method of dynamically controlling image density in an electrophotographic imaging system that includes at least one development station for applying toner to an electrostatic latent image, the method comprising:

for each development station, approximating a first time delay between toner concentration sensing and image development, a second time delay between development and toner dispense, a third time delay caused by transport of toner from a toner dispense location to a toner concentration sensor, and a fourth parameter representing the time required to dispensed toner;

storing said time delays in a memory to establish a toner delivery model;

using said toner delivery model to generate a toner concentration correction signal representing a deviation from as desired toner concentration at a development roll of the imaging system in order to control an electrostatic controller.

9. The method of claim 8 wherein the electrophotographic imaging system includes a density sensor that measures print density to generate a density signal, the toner delivery model being further modified in accordance with the density signal.

10. The method of claim 8 wherein the imaging system includes an electrostatic development field, and the method further includes adjusting the electrostatic development field by measuring and adjusting a voltage bias on a charge retentive surface.

11. The method of claim 8 wherein the method further includes adjusting the electrostatic controller by adjusting exposure level employed to generate the latent image.

12. The method of claim 8 further including modifying the toner delivery model by measuring toner density to produce a density signal, and applying the density signal to the toner delivery model to compute adjustments to the correction signal.

13. An apparatus that dynamically controls image density in an electrostatographic imaging system that includes at least one development station for applying toner to an electrostatic latent image, the apparatus comprising:

a software model that emulates the behavior of at least one of toner concentration, mixing delay of toner, and transport of toner during a development cycle of the latent image; and a controller that dynamically adjusts the amount of toner particles applied to the latent image according to the software model during a reproduction job stream.

14. The apparatus as recited in claim 13, further including an electrostatic control, and said controller being operative to alter electrostatic set points of the electrostatic control to maintain a desired toner density in a developed image.

15. The apparatus as recited in claim 14, wherein said controller controls toner concentration in a two-component developer mixture of toner and carrier particles.

16. The apparatus as recited in claim 14, wherein said controller effects correction of said software model according to actual measurements of behavior of at least one of toner concentration, mixing delay, and transport delay during a reproduction job stream.

17. The apparatus as recited in claim 16, wherein said controller repeats correction during a reproduction job stream.

18. The apparatus as recited in claim 17, wherein said controller periodically compensates for long-term drift in a desired toner density using an image density sensor that senses toner density in the developed image.

19. The apparatus as recited in claim 18, wherein said controller periodically corrects behavior of the software model according to pixel count information of an original document being reproduced.

20. An apparatus that dynamically controls toner density in an electrophotographic imaging system comprising:

for each developer station, a software model that approximates at least one of a first time delay between toner concentration sensing and image development, a second time delay caused by toner mixing, and a third time delay caused by transport of mixed toner;

a memory that stores said time delays to establish a toner delivery model; and a controller that modifies said toner delivery model in response to actual measurements of at least one of said first, second, and third time delays, and that determines a toner density correction signal based on a modified toner delivery model, said controller outputting control signals to adjust an electrostatic field during development of a latent image in response to the correction signal.

* * * * *